US005622765A

United States Patent [19]

Clementini et al.

[11] Patent Number: 5,622,765

[45] Date of Patent: Apr. 22, 1997

[54] RESILIENT HIGH SHRINKAGE PROPYLENE POLYMER YARN AND ARTICLES MADE THEREFROM

[75] Inventors: Luciano Clementini, Terni, Italy; Adam F. Galambos, New Castle County, Del.; Giuseppe Lesca, Milan, Italy; Kumar Ogale, New Castle County, Del.; Leonardo Spagnoli, Terni, Italy; Michael E. Starsinic, Cecil County, Md.

[73] Assignee: Montell North America Inc., Wilmington, Del.

[21] Appl. No.: 531,983

[22] Filed: Sep. 21, 1995

Related U.S. Application Data

[60] Division of Ser. No. 371,056, Jan. 10, 1995, Pat. No. 5,486,419, which is a continuation-in-part of Ser. No. 824, 661, Jan. 23, 1992, abandoned.

[51] Int. Cl.[6] ..... B32B 3/02; C08L 23/06; C08F 10/04

[52] U.S. Cl. ..... 428/97; 428/365; 525/240; 526/348.6; 526/916

[58] Field of Search ..... 428/97, 365; 525/240; 526/348.6, 916

[56] References Cited

U.S. PATENT DOCUMENTS

| | | | |
|---|---|---|---|
| 3,577,615 | 5/1971 | LeNoir | 28/72.12 |
| 3,657,062 | 4/1972 | Eshima et al. . | |
| 3,698,177 | 10/1972 | Nyfeler | 57/157 |
| 3,808,304 | 4/1974 | Schirmer . | |
| 3,852,948 | 12/1974 | Ruddell et al. . | |
| 4,161,574 | 7/1979 | Strametz et al. | 526/159 |
| 4,211,819 | 7/1980 | Kunimune et al. | 428/374 |
| 4,351,930 | 9/1982 | Patnaik | 526/916 |
| 4,634,745 | 1/1987 | Ehrig et al. | 526/87 |
| 4,704,856 | 11/1987 | Nelson | 57/228 |
| 4,839,211 | 6/1989 | Wilkie et al. . | |
| 4,882,222 | 11/1989 | Talley et al. . | |
| 5,058,371 | 10/1991 | Yu et al. . | |
| 5,102,713 | 4/1992 | Corbin et al. . | |
| 5,272,023 | 12/1993 | Yamamoto et al. | 428/198 |
| 5,455,305 | 10/1995 | Galambos | 525/240 |
| 5,486,419 | 1/1996 | Clementini et al. | 428/397 |

FOREIGN PATENT DOCUMENTS

| | | |
|---|---|---|
| 63-95209 | 4/1988 | Japan . |

*Primary Examiner*—Terrel Morris

[57] ABSTRACT

Saxony carpet containing a pile yarn comprising propylene polymer yarn of increased resiliency and shrinkage, compared to crystalline propylene homopolymer yarn, having a continuous strand of multiple monofilament fibers, said fibers consisting essentially of certain propylene polymer blends and materials.

2 Claims, 2 Drawing Sheets

RESILIENT HIGH SHRINKAGE PROPYLENE POLYMER YARN AND ARTICLES MADE THEREFROM

This application is a division of application Ser. No. 08,371,056, filed Jan. 10, 1995, now U.S. Pat. 5,486,419, which is a continuation-in-part of U.S. Ser. No. 07/824,661, filed Jan. 23, 1992 now abandoned.

FIELD OF THE INVENTION

Resilient yarn produced from fibers of propylene polymer material. More particularly, it relates to yarn and pile fabric such as carpeting made therefrom, in which the fiber is a propylene terpolymer or copolymer and mixtures thereof. Specifically, the invention relates to yarn produced from propylene polymer compositions based on terpolymers of propylene with ethylene and $C_4$–$C_8$ alpha-olefin; compositions of copolymers of propylene with $C_4$–$C_8$ alpha-olefin together with copolymers of propylene and ethylene or terpolymers of propylene-ethylene-$C_4$–$C_8$ alpha-olefin; compositions of terpolymers of propylene, ethylene and $C_4$–$C_8$ alpha-olefin in combination with copolymers of propylene and $C_4$–$C_8$ alpha-olefin as well as copolymers of ethylene and $C_4$–$C_8$ alpha-olefin; random crystalline propylene copolymers with ethylene or a $C_4$–$C_8$ alpha-olefin as well as such compositions containing elastomeric propylene copolymers. In particular, the invention relates to yarn produced from blends of such copolymers and terpolymers and compositions with crystalline polypropylene homopolymer.

BACKGROUND OF THE INVENTION

In addition to its significant use in structural elements such as molded parts, polypropylene has found significant use as a fiber and in yarn, particularly carpet yarn. In order to capitalize on its strength, high melting point and chemical inertness, as well as low cost, the polymer typically used for such applications has been crystalline homopolymer polypropylene. However, this polymer has limited resilience which detracts from its performance in carpeting. Resiliency is a measure of the ability of a fiber or yarn to recover fully its original dimensions upon release of a stress which is compressing it. In the case of polypropylene carpet the poor resiliency is demonstrated by the "walking out" of a sculptured carpet in highly trafficked areas or by the matting which occurs on the walked-on areas of level pile carpets. The matting phenomenon also occurs in upholstery which contains polypropylene pile yarn. Such deficiencies resulted in earlier attempts to improve polypropylene homopolymer performance by modifying the method of crimping the fibers comprising the yarn, U.S. Pat. No. 3,686,848.

Fibers obtained from mechanical blends of homopolymers of polypropylene and polyethylene are known; the thermoshrinkable values of such fibers are good and not very temperature dependent. However, such fibers have the disadvantage of not being very wear-resistant, since they are prone to "fibrillation": the single fiber, after having been subjected to mechanical stress, when examined under a microscope shows longitudinal tears. Such fibrillation is very evident during the manufacture of carpets, and it makes such blends undesirable for this use.

The limited resiliency of polypropylene in carpeting and other fiber/fabric applications is also discussed in "Textile Science and Technology, Polypropylene Fibers-Science and Technology" by M. Ahmed, (Elsevier Press). That reference acknowledges that polypropylene based on commercial fibers is considered intermediate in resilience characteristics between polyester and nylon although "specially prepared fibers" may surpass nylon and approach wool. The reference presents a graph (FIG. 6) that shows resilience, as measured by pile retention, affected by heat setting and draw ratio. It is stated that "(t)here is general agreement that resilient fiber must exhibit high crystalline orientation and high fraction of a-axis oriented crystallites."

While copolymers of propylene with alpha-olefin comonomers have been prepared, such polymers have been used in applications other than yarns, fabrics and carpeting. For example, U.S. Pat. No. 4,322,514 discloses that copolymers based on 80–98 mole % polypropylene, 0.2–15 mole % ethylene and 0.2–15 mole % straight-chained alpha-olefin of $C_4$ or more result in suitably soft, non- or low-crystalline copolymers having superior transparency, blocking resistance, heat-sealing property and flexibility "for molding into various products; including films, sheets and hollow containers." Blends with other thermoplastic resins such as polypropylene were also recognized for improving the strength, impact resistance, transparency and low-temperature characteristics of the other resin, i.e., to function as a resin modifier. The copolymerization was carried out using an electron donor free catalyst comprising (1) a solid substance containing magnesium and titanium and (2) organometallic compound.

U.S. Pat. No. 4,351,930 discloses a copolymerization process which employs an electron donor containing catalyst for production of a propylene-ethylene-butene-1 copolymer having 80 to 96.5 weight percent propylene, 3 to 17 weight percent ethylene and 0.5 to 5 weight percent butene-1. While a copolymer is produced which contains butene-1, the expressed objective of the process is to provide an improved process for liquid phase ("pool") production of ethylene-propylene copolymers, particularly with enhanced ethylene content and acceptable isotacticity suitable for use as heat sealable films. In passing, it is disclosed that "in addition to the fabrication of film the polymers can be used with advantage in the manufacture of fibers and filaments by extrusion, of rigid articles by injection molding, and of bottles by blow molding techniques." (Essentially a statement of the general uses of thermoplastic polyolefin homopolymers and copolymers).

U.S. Pat. No. 4,181,762 discloses the production of fibers, yarns and fabrics from low modulus polymer. The thermoplastic polymer on which the inventor focuses is an ethylene vinyl acetate (EVA) copolymer, particularly one which has been partially crosslinked to increase the inherently low melting point of EVA. Furthermore, the invention relies on the use of a relatively large diameter fiber in order to achieve a sufficient moment of inertia for that low modulus material to perform satisfactorily in a carpet yarn. While other polymers and copolymers are generally disclosed, they are not defined with any specificity and the copolymers, terpolymers and blends of the present invention are not suggested at all.

U.S. Pat. No. 4,960,820 discloses blends containing "no more than 10% by weight of a low molecular weight, isotactic poly-1-butene polymer with a melt index of greater than 100 to about 1000" with propylene homopolymers and copolymers in order to improve the gloss and clarity of the propylene polymer. The reference includes disclosure of mono- and multifilament fibers with improved stretchability. The reference proposes that such fibers are capable of being spun because "the high melt index butene-1 polymers act as a lubricant or plasticizer for the essentially polypropylene fibers." The reference essentially relates to polypropylene fibers, does not suggest the preparation of yarn and does not even incidentally disclose the use of such fibers for the preparation of carpeting.

SUMMARY OF THE INVENTION

It has been surprisingly found that polyolefin yarn capable of increased resiliency and shrinkage particularly useful in pile fabric and carpeting can be produced comprising continuous strand of multiple monofilament fibers (bulk continuous filament and staple) of propylene polymer material optionally blended with polypropylene homopolymer. In one embodiment the propylene polymer material is a random crystalline terpolymer consisting essentially of propylene with defined lesser amounts of ethylene and $C_4$–$C_8$ alpha-olefin.

In another embodiment, polyolefin yarn of increased resiliency and shrinkage is produced from a fiber comprising a blend of propylene co-and terpolymers, including therein polymers comprising monomers of propylene and a $C_4$–$C_8$ alpha-olefin, and propylene and ethylene and optionally a $C_4$–$C_8$ alpha-olefin. Still another embodiment includes polyolefin yarn of increased resiliency and shrinkage from a blend of propylene co- and terpolymers, including therein polymers comprising monomers of propylene and a $C_4$–$C_8$ alphaolefin, and further including a predominantly ethylene copolymer with a $C_4$–$C_8$ alpha-olefin. Another embodiment is a yarn of increased resiliency and shrinkage comprising a composition of random crystalline propylene polymer of minor amounts of ethylene or a $C_4$–$C_8$ alpha-olefin. Particularly useful thermoshrinkable fibers characterize another embodiment comprising a blend of polypropylene homopolymer and/or crystalline copolymer of propylene with a minor amount of ethylene and/or a $C_4$–$C_8$ alpha-olefin; and a propylene elastomeric copolymer comprising major amounts of a $C_4$–$C_8$ alpha-olefin comonomer. A further, preferred, embodiment of this invention comprises polyolefin yarn of increased resiliency and shrinkage produced from blends of propylene polymer material with up to about 70 weight percent crystalline polypropylene homopolymer.

DETAILED DESCRIPTION OF THE INVENTION

Figure 1:
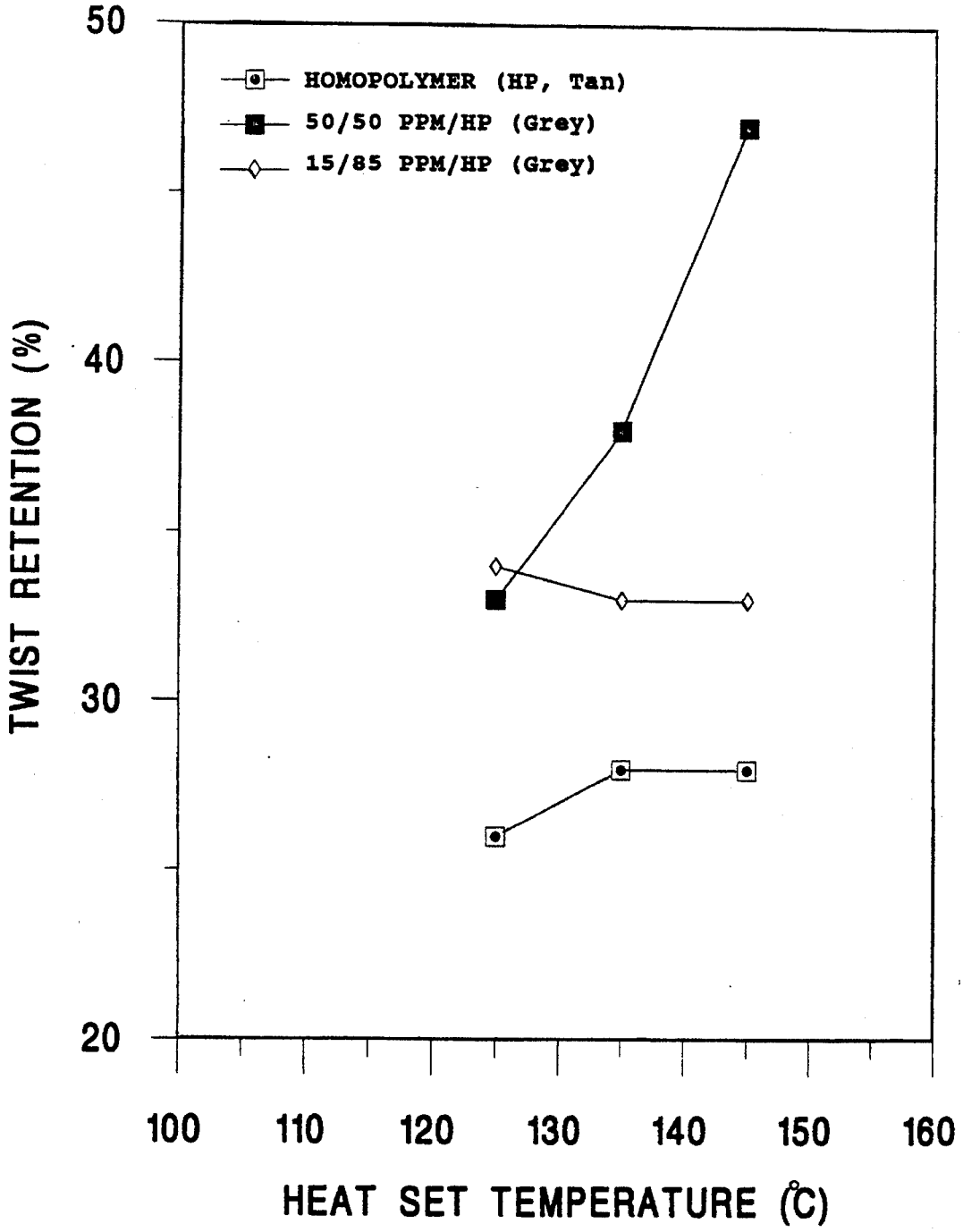
FIG. 1 is a graph showing the relationship between yarn twist retention and heat set temperature for a pigmented polypropylene homopolymer control and two blend composition embodiments of the invention.

All percentages and parts in this patent specification are by weight unless stated otherwise.

The synthetic polymer resin formed by the polymerization of propylene as the sole monomer is called polypropylene. The well-known crystalline polypropylene of commerce is a normally solid, predominantly isotactic, semi-crystalline, thermoplastic homopolymer formed by the polymerization of propylene by Ziegler-Natta catalysis. In such catalytic polymerization the catalyst is formed by an organic compound of a metal of Groups I–III of the Periodic Table, (for example, an aluminum alkyl), and a compound of a transition metal of Groups IV–VIII of the Periodic Table, (for example, a titanium halide). A typical crystallinity is about 60% as measured by X-ray diffraction. As used herein, semi-crystalline means a crystallinity of at least about 5–10% as measured by X-ray diffraction. Also, the typical weight average molecular weight (Mw) of the normally solid polypropylene of commerce is 100,000–4,000,000, while the typical number average molecular weight (Mn) thereof is 40,000–100,000. Moreover, the melting point of the normally solid polypropylene of commerce is from about 159°–169° C., for example 162° C.

As used herein propylene polymer material means: (I) a polymer selected from the group consisting of (a) random crystalline propylene terpolymers consisting essentially of from about 85–96%, preferably about 90–95%, more preferably about 92–94% propylene, and from about 1.5–5.0%, preferably about 2–3%, more preferably about 2.2–2.7% ethylene and from about 2.5–10.0%, preferably about 4–6%, more preferably about 4.5–5.6% of an olefin selected from the group consisting of $C_4$–$C_8$ alpha-olefins, wherein the total comonomer concentration with propylene is from about 4.0 to about 15.0% (mixtures of such terpolymers can be used); (b) compositions of random crystalline propylene polymers comprising: (1) 30–65%, preferably 35–65%, more preferably 45–65% of a copolymer of from about 80%–98%, preferably about 85–95% propylene with a $C_4$–$C_8$ alpha-olefin; and (2) 35–70%, preferably 35–65%, more preferably 35–55% of a copolymer of propylene and ethylene and optionally from about 2–10%, preferably 3–6% of a $C_4$–$C_8$ alphaolefin, said copolymer containing 2–10% ethylene, preferably 7–9% when said $C_4$–$C_8$ alpha-olefin is not present and 0.5–5%, preferably 1–3% when said $C_4$–$C_8$ alpha-olefin is present (mixtures of such copolymers can be used); (c) compositions of crystalline propylene polymers in combination with a predominantly ethylene copolymer consisting essentially of: (1) about 15–35%, preferably 17–33% more preferably 20–30% of a terpolymer of from about 90–93% preferably about 91–93% propylene and about 2–3.5% preferably about 2.2–3.2% ethylene and about 5–6% preferably about 5.5–6.5% $C_4$–$C_8$ alpha-olefin (and mixtures of such terpolymers); and (2) about 30–75% preferably 34–70%, more preferably 40–60% of a copolymer of from about 80–90%, preferably about 85–95% propylene with a $C_4$–$C_8$ alpha-olefin (and mixtures of such copolymers); and (3) about 20–60%, preferably 25–58%, more preferably 30–50% of a copolymer of from about 91–95%, preferably 92–94% ethylene with a $C_4$–$C_8$ alpha-olefin (and mixtures of such copolymers); and (d) compositions of random crystalline propylene polymer comprising from about 1.5 to about 20.0 weight percent ethylene or a $C_4$–$C_8$ alpha-olefin, preferably about 3.0 to about 18.0 percent, more preferably for ethylene about 4.0 to about 8.0 percent and for a $C_4$–$C_8$ alpha-olefin about 8.0 to about 6.0 percent; when an alpha-olefin other than ethylene is used, it is preferably butene-1. Component (c)(3) is known in the art as linear low density polyethylene. Composition (c) also can be prepare by blending, after polymerization, component (c)(3) with polymerized composition comprising components (c)(1) and (c) (2); preferably components (a), (b) and (c) are prepared by direct polymerization. Additionally useful are (II) heterophasic polyolefin compositions obtained by sequential copolymerization or mechanical blending, comprising: a) homopolymers of propylene, or its crystalline copolymers with ethylene and/or other α-olefins, and b) an ethylene-propylene elastomeric copolymer fraction.

Heterophasic polyolefin compositions of this type are included, for example, among those described in European patent application EP 1-416 379, and in European patent EP B-77 532. However, these references do not disclose that polyolefin compositions of this type can be used to produce highly thermoshrinkable fibers. The preferred propylene polymer material of the present invention is (I) (a).

Heterophasic polyolefin compositions of the present invention are capable of producing fibers which not only are light, highly impermeable, insulating, wear and static resistant, properties typical of polypropylene homopolymer fibers, but also are highly thermoshrinkable and which are not very temperature dependent.

Heterophasic polyolefin compositions identified as (II), above, comprise (by weight):

a) 90–55 parts, preferably 60–80, of polypropylene homopolymer having an isotactic index greater than 90, and/or a crystalline copolymer of propylene with ethylene and/or with an α-olefin of formula $CH_2{=}CHR$, where R is a $C_2$–$C_6$ alkyl radical, containing less than 10% of ethylene and/or α-olefin, preferably from 0 5 to 9%, more preferably from 2 to 6% by weight, and b) 10–45 parts, preferably 20–40, of an elastomeric copolymer of propylene with ethylene and/or with an α-olefin of formula $CH_2{=}CHR$, where R is a $C_2$–$C_6$ alkyl radical, containing from 50 to 70 parts by weight of comonomers, and from 10 to 40% by weight of a portion insoluble in xylene at ambient temperature.

The $C_4$–$C_8$ alpha-olefin is selected from the group consisting of linear and branched alpha-olefins such as, for example, 1-butene; isobutylene; 1-pentene; 1-hexene; 1-octene; 3-methyl-1-butene; 4-methyl-1-pentene; 3,4-dimethyl-1-butene; 3-methyl-1-hexene and the like. Particularly preferred is 1-butene.

Particularly preferred compositions for use in preparation of yarn are those in which up to about 70% crystalline polypropylene homopolymer is blended with the above described propylene polymer material; more preferred are compositions including from about 10 to about 70% crystalline polypropylene; still more preferred from about 35 to about 65%; most preferred from about 40 to about 60%; for example, a blend of 50% crystalline polypropylene with 50% propylene polymer material, wherein the latter is most preferably a terpolymer of propylene-ethylene-butene-1 including about 5.0% butene-1 and about 2.5% of ethylene (available from HIMONT U.S.A., Inc.).

The crystalline propylene polymer material disclosed hereinabove as: (a) terpolymers consisting essentially of propylene-ethylene-$C_4$–$C_8$ alpha-olefin (e.g., propylene-ethylene-butene-1); and (b) compositions comprising (1) propylene-$C_4$–$C_8$ alpha-olefin copolymer (e.g., propylene-butene-1) and (2) propylene-ethylene copolymer or propylene-ethylene-$C_4$–$C_8$ alpha-olefin terpolymer (e.g., propylene-ethylene-butene-1) and (c) compositions consisting essentially of (1) propylene-ethylene-$C_4$–$C_8$ alpha-olefin terpolymer (e.g., Propylene-ethylene-butene-1) and (2) propylene-$C_4$–$C_8$ alpha-olefin copolymer (e.g., propylene-butene-1) and (3) ethylene-$C_4$–$C_8$ alpha-olefin copolymer (e.g., ethylene-butene-1) are preferably produced according to the polymerization process and using the catalysts disclosed in U.S. Ser. No. 763,695, filed Sep. 23, 1991, which is incorporated herein by reference. These polymers and polymer compositions are generally prepared by sequential polymerization of monomers in the presence of stereospecific Ziegler-Natta catalysts supported on activated magnesium dihalides (e.g., preferred is magnesium chloride) in active form. Such catalysts contain, as an essential element, a solid catalyst component comprising a titanium compound having at least one titanium-halogen bond and an electron-donor compound, both supported on a magnesium halide in active form. Useful electron-donor compounds are selected from the group consisting of ethers, ketones, lactones, compounds containing nitrogen, phosphorous and/or sulfur atoms, and esters of mono- and dicarboxylic acids; particularly suited are phthalic acid esters. Aluminum alkyl compounds which can be used as co-catalysts include the aluminum trialkyls, such as aluminum triethyl, trisobutyl and tri-n-butyl, and linear or cyclic aluminum alkyl compounds containing two or more aluminum atoms bound between them by oxygen or nitrogen atoms, or by $SO_4$ and $SO_3$ groups. The aluminum alkyl compound generally is used in such quantities as to the cause the Al/Ti ratio to be from 1 to 1000.

In the solid catalyst component, the titanium compound expressed as Ti generally is present in a percentage by weight of 0.5 to 10%; the quantity of electron-donor compound which remains fixed on the solid (internal donor) generally is of 5 to 20 mole % with respect to magnesium dihalide.

The titanium compounds which can be used for the preparation of the catalyst components are halides and halogen alcoholates; titanium tetrachloride is the preferred compound.

The electron-donor compounds that can be used as external donors (added to the aluminum alkyl compound) include aromatic acid esters, such as alkyl benzoates, and in particular, silicon compounds containing at least one Si-OR bond where R is a hydrocarbon radical, 2,2,6,6-tetramethylpiperidene and 2,6 diisopropylpiperidene.

As disclosed in U.S. Ser. No. 763,695 referred to above, the solid catalyst component is prepared according to various described methods. According to one method, a $MgCl_2.nROH$ adduct (particularly in the form of spheroidal particles), where n is generally a number from 1 to 3 and ROH is ethanol, butanol or isobutanol, is caused to react with excess $TiCl_4$ containing the electron-donor compound in solution. The temperature is generally between 80° and 120° C. The solid is then isolated and caused to react once more with $TiCl_4$, then separated and washed with a hydrocarbon until no chlorine ions are found in the washing liquid.

Where the propylene polymer material comprises more than one polymer, for example other than (a), polymerization is carried out in at least two stages, preparing components (b)(1) and (b)(2) or (c)(1), (c)(2) and (c)(3) identified above, in separate and successive stages, operating in each stage in the presence of the polymer and the catalyst of the preceding stage. The order of preparation is not critical, but the preparation of (b)(1) before (b)(2) is preferred. Polymerization can be continuous, discontinuous, liquid phase, in the presence or absence of an inert diluent, in the gas phase or in mixed liquid-gas phases; gas phase is preferred. Alternatively, components (c)(1) and (c)(2) can be prepared by sequential polymerization and subsequently blended with (c)(3).

Reactor temperature is not critical, it can typically range from 20° C. to 100° C. and reaction time is not critical. In addition, known molecular weight regulators such as hydrogen, can be used.

Precontacting the catalyst with small quantities of olefins (prepolymerization) improves both catalyst performance and polymer morphology. Such a process can be achieved in a hydrocarbon solvent such as hexane or heptane at a temperature of from ambient to 60° C. for a time sufficient to produce quantities of polymer from 0.5 to 3 times the weight of the solid catalyst component. It can also be carried out in liquid propylene at the same temperatures, producing up to 1000 g polymer per g of catalyst.

Since each of components (b) and (c) are preferably produced directly during polymerization these components are optionally mixed in each polymer particle. Preferred are spherical particles with a diameter of from 0.5 to 4.5 mm produced using the catalysts described in U.S. Pat. No. 4,472,524.

The heterophasic polymer compositions from which one can obtain the fibers of the invention are also available commercially (HIMONT U.S.A., Inc.). Such polymer compositions can also be prepared by way of sequential polymerization, where the individual components are produced in each one of the subsequent stages; for example, one can polymerize propylene in the first stage, optionally with minor quantities of ethylene and/or an α-olefin to form component (a), and in the second stage one can polymerize the blends of propylene with ethylene and/or with an α-olefin to form elastomeric component (b). In each stage one operates in the presence of the polymer obtained and the catalyst used in the preceding stage.

The operation can take place in liquid phase, gas phase, or liquid-gas phase. The temperature in the various stages of polymerization can be equal or different, and generally ranges from 0° C. to 100° C. As molecular weight regulators one can use the traditional chain transfer agents known in the art, such as hydrogen and $ZnEt_2$.

The sequential polymerization stages take place in the presence of stereospecific Ziegler-Natta catalysts supported on magnesium dihalides in active form. Such catalysts contain, as essential elements, a solid catalyst component comprising a titanium compound having at least one titanium-halide bond and an electron-donor compound supported on magnesium halide in active form. Catalysts having these characteristics are well known in patent literature. The catalysts described in U.S. Pat. No. 4,339,054 and EP patent 45 977 have proven to be particularly suitable. Other examples of catalysts are described in U.S. Pat. Nos. 4,472,524, and 4,473,660.

As electron-donor compounds, the solid catalyst components used in these catalysts contain compounds selected from the ethers, ketones, lactones, compounds containing N, P, and/or S atoms, and esters of mono- and dicarboxylic acids. Particularly suitable are the phthalic acid esters, such as diisobutyl, dioctyl and diphenylphthalate, benzylbutylphthalate; esters of malonic acid such as diisobutyl and diethylmalonate; alkyl and arylpivalates, alkyl, cycloalkyl and aryl maleates, alkyl and aryl carbonates such as diisobutyl carbonate, ethyl phenylcarbonate and diphenylcarbonate; esters of succinic acid such as mono and diethyl succinate. Other particularly suitable electron-donors are the 1,3-diethers of formula:

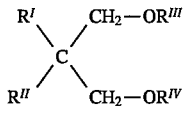

where $R^I$ and $R^{II}$, equal or different, are alkyl, cycloalkyl, or aryl radicals with 1–18 carbon atoms; $R^{III}$ or $R^{IV}$, equal or different, are alkyl radicals with 1–4 carbon atoms.

Suitable esters are described in published European patent application EP 361 493. Representative examples of said compounds are 2-methyl-2-isopropyl-1,3-dimethoxypropane, 2,2-diisobutyl-1,3-dimethoxypropane, 2-isopropyl-2-cyclopentyl-1,3-dimethoxypropane.

In the solid catalyst component, the titanium compound expressed as Ti is generally present in a percentage of from 0.5 to 10% by weight; the quantity of electron-donor which remains on the solid component (internal donor) generally comprises from 5 to 20% in moles with respect to the magnesium dihalide.

The active form of the magnesium halides in the solid catalyst components is recognizable by the fact the X-ray spectrum of the catalyst component no longer has the maximum intensity reflection which appear son the spectrum of nonactivated magnesium halides (having a surface area smaller than 3 $m^2/g$), but in its place there is a halo where the maximum intensity has shifted with respect to the position of the maximum intensity reflection of the nonactivated magnesium; or by the fact that the maximum intensity reflection presents a mid-height width at least 30% greater than that of the maximum intensity reflection which appears in the spectrum of the nonactivated magnesium halide. The most active forms are those in which the halo appears in the X-ray spectrum.

The Al-alkyl compounds used as co-catalysts comprise the Al-trialkyls such as Al-triethyl, Al-triisobutyl, Al-tri-n-butyl, and linear or cyclic Al-alkyl compounds containing two or more Al atoms linked between them with O or N atoms, or $SO_4$ and $SO_3$ groups.

The propylene polymer material is preferably a "visbroken" polymer having a melt flow rate (MFR, according to ASTM D-1238, measured at 230° C., 2.16 kg) of from about 5 to 100, preferably from about 15 to 50, more preferably from about 25 to 45, having an original MFR of from about 0.5 to 10, preferably about 5. Alternatively, the propylene polymer material can be produced directly in the polymerization reactor to the preferred MFR. If desired, visbreaking can be carried out in the presence or absence of crystalline polypropylene.

The process of visbreaking crystalline polypropylene (or a propylene polymer material) is well known to those skilled in the art. Generally, it is carried out as follows: propylene polymer or polypropylene in "as polymerized" form, e.g., flaked or pelletized, has sprayed thereon or blended therewith, a prodegradant or free radical generating source, e.g., a peroxide in liquid or powder form or absorbed on a carrier, e.g., polypropylene (Xantrix 3024, manufactured by HIMONT U.S.A., Inc). The polypropylene or propylene polymer/peroxide mixture is then introduced into a means for thermally plasticizing and conveying the mixture, e.g., an extruder at elevated temperature. Residence time and temperature are controlled in relation to the particular peroxide selected (i.e., based on the half-life of the peroxide at the process temperature of the extruder) so as to effect the desired degree of polymer chain degradation. The net result is to narrow the molecular weight distribution of the propylene containing polymer as well as to reduce the overall molecular weight and thereby increase the MFR relative to the as-polymerized polymer. For example, a polymer with a fractional MFR (i.e., less than 1), or a polymer with a MFR of 0.5–10, can be selectively visbroken to a MFR of 15–50, preferably 28–42, e.g., about 35, by selection of peroxide type, extruder temperature and extruder residence time without undue experimentation. Sufficient care should be exercised in the practice of the procedure to avoid crosslinking in the presence of an ethylene-containing copolymer; typically, crosslinking will be avoided where the ethylene content of the copolymer is sufficiently low.

The rate of peroxide decomposition is defined in terms of half-lives, i.e. the time required at a given temperature for one-half of the peroxide molecules to decompose. It has been reported (U.S. Pat. No. 4,451,589) for example, that using Lupersol 101 under typical extruder pelletizing conditions (450° F., 2 ½ minutes residence time), only $2\times10^{-13}$% of the peroxide would survive pelletizing.

In general, the prodegradant should not interfere with or be adversely affected by commonly used polypropylene stabilizers and should effectively produce free radicals that upon decomposition initiate degradation of the polypropylene moiety. The prodegradant should have a short enough half-life at a polymer manufacturing extrusion temperatures, however, so as to be essentially entirely reacted before exiting the extruder. Preferably they have a half-life in the polypropylene of less than 9 seconds at 550° F. so that at least 99% of the prodegradant reacts in the molten polymer before 1 minute of extruder residence time. Such prodegradants include, by way of example and not limitation, the following: 2,5-dimethyl 2,5bis-(t-butylperoxy) hexyne-3 and 4 methyl 4 t-butylperoxy-2 pentanone (e.g. Lupersol 130 and Lupersol 120 available from Lucidol Division, Penwalt Corporation, 3,6,6,9,9-penthanethyl-3-(ethyl acetate) 1,2,4,5-textraoxy cyclononane (e.g, USP-138 from Witco Chemical Corporation), 2,5-dimethyl-2,5 bis-(t-butylperoxy) hexane (e.g., Lupersol 101) and alpha, alpha' bis-(tert-butylperoxy) diisopropyl benzene (e.g., Vulcup R from Hercules, Inc.). Preferred concentration of the free radical source prodegradants are in the range of from about 0.01 to 0.4 percent based on the weight of the polymer(s). Particularly preferred is Lupersol 101 wherein the peroxide is sprayed onto or mixed with the propylene polymer at a concentration of about 0.1 wt. % prior to their being fed to an extruder at about 230° C., for a residence time of about 2 to 3 minutes. Extrusion processes relating to the treatment of propylene-containing polymers in the presence of an organic peroxide to increase melt flow rate and reduce viscosity are known in the art and are described, e.g., in U.S. Pat. Nos. 3,862,265; 4,451,589 and 4,578,430.

The conversion of propylene polymer material with or without polypropylene homopolymer in, e.g., pellet form, to fiber form is accomplished by any of the usual spinning methods well known in the art. Since such propylene polymer material can be heat plasticized or melted under reasonable temperature conditions, the production of the fiber is preferably done by melt spinning as opposed to solution processes. The heterophasic compositions identified as (II) are particularly suitable for producing thermoshrinkable fibers.

In the process of melt spinning, the polymer is heated in an extruder to the melting point and the molten polymer is pumped at a constant rate under high pressure through a spinnerette containing a number of holes; e.g., having a length to diameter ratio greater than 2. The fluid, molten polymer streams emerge downward from the face of the spinnerette usually into a cooling stream of gas, generally air. The streams of molten polymer are solidified as a result of cooling to form filaments and are brought together and drawn to orient the molecular structure of the fibers and are wound up on bobbins.

The drawing step may be carried out in any convenient manner using techniques well known in the art such as passing the fibers over heated rolls moving at differential speeds. The methods are not critical but the draw ratio (i.e., drawn length/undrawn length) should be in the range of about 1.5 to 7.0:1, preferably about 2.5 to 4.0:1; excessive drawing should be avoided to prevent fibrillation. The fibers are combined to form yarns which are then textured to impart a crimp therein. Any texturizing means known to the art can be used to prepare the yarns of the present invention, including methods and devices for producing a turbulent stream of fluid, U.S. Pat. No. 3,363,041. Crimp is a term used to describe the waviness of a fiber and is a measure of the difference between the length of the unstraightened and that of the straightened fibers. Crimp can be produced in most fibers using texturizing processes. The crimp induced in the fibers of the present invention can have an arcuate configuration in three axes (such as in an "S") as well as fibers possessing a sharp angular configuration (such as a "Z"). It is common to introduce crimp in a carpet fiber by the use of a device known as a hot air texturizing jet. For production of cut staple yarn, crimp also can be introduced using a device known as a stuffer box. After crimp is imposed on the yarn, it is allowed to cool, it is taken from the texturizing region with a minimum of tension and wound up under tension on bobbins.

The yarn is preferably twisted after texturizing. Twisting imparts permanent and distinctive texture to the yarn and to carpet incorporating twisted yarn. In addition, twisting improves tip definition and integrity; the tip referring to that end of the yarn extending vertically from the carpet backing and visually and physically (or texturally) apparent to the consumer. Twist is ordinarily expressed as twists per inch or TPI. In the carpet yarn of the prior art, employing a polyolefin such as polypropylene homopolymer, yarn diameter decreases as TPI increases. As a result, it is necessary to incorporate more individual yarn tufts, or face yarn, to maintain carpet aesthetics using a yarn with a high number of TPI. However, utilizing the compositions of the present invention to produce fiber, yarn and carpeting, the fiber and resulting yarn is capable of high shrinkage levels. Therefore, after plying and heat setting of such yarns, TPI increase and the yarn diameter also increases as a consequence of shrinkage. It is possible to set the level of TPI independently by taking into consideration the shrinkage of the yarn composition on heat setting and adjusting the initial value of TPI. Similarly, denier is affected by shrinkage, but appropriate adjustment can be made to achieve the same final value, if desired. Additionally, individual filaments tend to buckle on contraction and structural limitations cause the buckling to occur outwardly. As a result, after tufting and shearing of loops, the resulting tufts are more entangled. The twisted yarn is thereafter heat treated to set the twist so as to "lock-in" the structure. In yarn made from nylon fiber, twist is retained as a result of hydrogen bonding and the presence of polar groups on the polymer chain. Since such bonding is not available in ordinary polypropylene homopolymer, it is difficult to retain the twist during use and there is a loss of resilience and of overall appearance due to matting. The unique yarn and carpet made therefrom based on the propylene polymer material disclosed herein, results in an ability to thermally lock in the twist structure during yarn processing. Additionally, yarn based on blends of propylene polymer material blended with crystalline polypropylene homopolymer produces a unique material with which one can take advantage of polypropylene homopolymer properties, but with the added feature of improved resilience. In the present invention, useful yarn is produced having about 0.5 to about 6.0 twists per linear inch; preferably about 3.5 to about 4.5. Generally, this step utilizes a stream of compressible fluid such as air, steam, or any other compressible liquid or vapor capable of transferring heat to the yarn as it continuously travels through the heat setting device, at a temperature about 110° C. to 150° C.; preferably 120° C. to 140° C.; more preferably about 120° C. to about 135° C., for example about 125° C. This process is affected by the length of time during which the yarn is exposed to the heating medium (time/temperature effect). Generally, useful exposure times are from about 30 seconds to about 3 minutes; preferably from about 45 seconds to about 1 ½ minutes; for example, about 1 minute.

The twisted yarn is preferably heat treated. Where heat treating of the fibers, filaments or yarn of the present invention is carried out, the temperature of the fluid must be such that the yarn does not melt. If the temperature of the yarn is above the melting point of the yarn it is necessary to shorten the time in which the yarn dwells in the texturizing region. (One type of heat setting equipment known in the art is distributed by American Superba Inc., Charlotte, N.C.). The yarn of the present invention is advantageously produced when it undergoes shrinkage upon heat setting of from about 10–70%, preferably about 15–65%, most preferably about 20–60%, for example about 25–55%; it is expected that the best performance will be obtained at a shrinkage level of at least about 30% for example about 50% for a blend of 50% polypropylene homopolymer and 50% type (a) propylene polymer material ( e.g., propylene-ethylene-butene-1 terpolymer). Yarn based on polypropylene and used commercially is not capable of achieving such desirable levels of shrinkage; typically such yarn of the prior art shrinks about 0–10%

In polyolefin fibers used to produce yarn and carpeting, there is what can be characterized as a reservoir of available shrinkage which is determined by the thermal characteristics of the composition and the processing conditions. Prior art fibers based on polypropylene homopolymer require sufficient thermal treatment during crimping and texturing such that the shrinkage upon heat setting is very low, for example 2–5%. In contrast, the compositions of the present invention are capable of being textured and crimped to desired levels at lower temperatures leaving a greater amount of residual shrinkage to be exerted during heat setting.

However, it is possible to modify the shrinkage response of the fibers and yarn of the present invention by operating at higher temperatures during texturing and crimping. Thus, the shrinkage characteristics of the carpet yarn of the invention, and its related properties of twist and twist retention can be selectively modified; such capabilities are not present in prior art polyolefin fibers and carpet yarn.

In the production of a carpet yarn, there are typically from about 50 to 250 fibers or filaments which are twisted together and bulked; preferably from about 90 to about 120 fibers; for example about 100 filaments.

The propylene polymer material, and in particular blends of such materials with crystalline polypropylene homopolymer, display a lowering of the heat softening temperature and a broadening of the thermal response curve as measured by differential scanning calorimetry (DSC).

Typically, crystalline homopolymer polypropylene displays a sharp melting peak in a DSC test at about 159° C. to 169° C., for example about 162° C. Heat setting yarn based on such a polymer requires precise temperature control to avoid melting of the fiber (which would destroy the fiber integrity) while at the same time operating at a sufficiently high temperature in an attempt to soften and thereby thermally lock in fiber twist, as well as to relieve stress in the fiber. Yarn based on the propylene polymer material of the present invention, and blends of such material with crystalline polypropylene homopolymer display a broadened thermal response curve. Such modified thermal response for propylene polymer material and blend compositions including polypropylene homopolymer, allows processing of such materials and compositions at a lower heat setting temperature while retaining yarn strength and integrity. (It should be appreciated that in blend compositions including significant amounts of polypropylene homopolymer, e.g., greater than about 30%, the yarn twist heat setting temperature should be sufficiently high to heat set the homopolymer component, e.g., greater than about 124° C.) These advantageous features are obtained and the composition can be processed using well known and efficient equipment developed over many years for the manufacture of yarn, fabric and carpet based on polypropylene homopolymer.

It will be appreciated that the present invention is compositionally defined as well as being defined by yarn performance. Therefore, polyolefin blends which might appear to satisfy limited criteria will not be acceptable overall. For example, blends of polyethylene and polypropylene homopolymer are not included within the scope of the invention in view of the tendency of polyethylene to fibrillate and in view of the reduced compatibility of such blends in comparison to blend compositions based on propylene polymer material and polypropylene homopolymer. Where blends are used, insufficient compatibility can compromise integrity of the fiber, the yarn and the resulting carpet and fabric.

Conventional additives may be blended with the polymer(s) used to produce the resilient yarn of the invention. Such additives include stabilizers, antioxidants, antislip agents, flame retardants, lubricants, fillers, coloring agents, antistatic and antisoiling agents, and the like.

The cross-section of the filaments or fibers which constitute the yarn is selected from the group consisting substantially circular and multi-lobed or n-lobal where n is an integer of at least 2, and other shapes including triangular, cruciform, H-shaped and Y-shaped. Preferred is a trilobal cross-section, in particular wherein the lobes contain one or more cavity extending along the length of the filament, e.g., hollow trilobal fibers. Particularly preferred is a trilobal filament wherein each lobe contains a cavity. Reference is made to U.S. Pat. No. 4,020,229 for a further detailed description of multi-cavity filaments, incorporated herein by reference. Filament, fiber and yarn dimensions are typically expressed in terms of denier. The term denier is a well known term of art defined as a unit of fineness for yarn equal to the fineness of a yarn weighing one gram for each 9,000 meters of length; accordingly, 100-denier yarn is finer than 150-denier yarn. Useful filaments and yarn of the present invention include those with denier before heat-setting in the range of about 500 to about 10,000; preferably from about 1,000 to about 4,200; more preferably 1,000 to 2,000. In addition to carpeting, the yarns of the present invention find utility in applications such as nonwovens, high gloss nonwovens and woven fabrics for upholstery, in carpet backing and in applications including geotextiles.

The present invention is particularly useful in view of the fact that equipment and technology developed over many years and directed to polypropylene homopolymer, especially for the manufacture of carpet, can be adapted according to the teachings herein to produce yarn and carpet with enhanced properties.

The expression "consisting essentially of" as used in this specification excludes an unrecited substance at a concentration sufficient to materially affect the basic and novel characteristics of the claimed invention.

The following examples are provided to illustrate, but not limit, the invention disclosed and claimed herein:

EXAMPLE 1

A propylene polymer material containing monomer concentrations (target) of 92.5 wt. % propylene, 2.5 wt. % of ethylene and 5.0 wt. butene-1 (grade KT-015T, available from HIMONT U.S.A., Inc.) was used in blends with homopolymer polypropylene to prepare fibers, yarn and carpeting. The propylene polymer was visbroken to a MFR of 20–35 from an initial, as polymerized value of 5.0. This was carried out by spraying 0.1 wt.% Lupersol 101 (present on a polypropylene carrier) onto the polymer flakes following polymerization, and extruding the peroxide-flake mixture at about 360° F. (232° C.), with a residence time of about 2–3 minutes. The homopolymer polypropylene was a commercially available product identified as Profax PF153 manufactured by HIMONT U.S.A., Inc with a MFR=35.

The process used to make carpet from this polymer included the steps of:

1. Spinning—molten polymer is made into filaments;
2. Drawing—filaments are stretched;
3. Texturizing—filaments are folded and optionally lightly air entangled to add bulk. By carrying out these steps with several filaments at the same time flat yarn was produced. Flat yarns were twisted together to produce a twisted yarn which was then heat set; the heat set and twisted yarn was then tufted, and a backing and latex added. The latex was then oven dried under standard conditions to produce a carpet.

Carpet production was carried out using commercial equipment known as a Barmag system. Three extruders were operated in tandem for the production of filaments. Each of the extruders was operated at a pressure of 120 Bar, at extrusion temperatures (°C.) of 200, 205, 210, and 215 in each of the four zones. (The heat transfer fluid was controlled at 225° C. to generate these temperature profiles.

The filaments were drawn at a draw ratio of 3.8:1 (3.7 for polypropylene homopolymer) and a draw temperature of 120° C. Texturizing was carried out at 120° C. (140° C. for polypropylene homopolymer) and at an air pressure of 96 psi (76 psi for polypropylene homopolymer). Carpeting was produced using yarn based on blends of the propylene polymer material (PPM) with polypropylene homopolymer (HP) in compositions of 50% PPM/50% HP; 30% PPM/70% HP; and 15% PPM/85 HP.

Blends of propylene polymer material were made using two methods: (1) preblending pellets of each component and pelletizing the mixture for subsequent extrusion to produce filaments; and (2) blending of pellets of each component at the filament extrusion stage. Direct comparison of these methods did not produce significantly different carpet results. Preblending was conveniently accomplished using a Henschel blender followed by extrusion of strands at about 200°–220° C. and chopping of the strands into pellets.

Flat yarn produced from a blend of 50% of PPM/50% HP had the following properties[(a)]:

| | |
|---|---|
| Tenacity, g/denier | 2.6–2.9 (18–19 ft-lbs.) |
| Elongation, % | 70 (100) |
| Denier | 1650 (2 ply = 3300) |
| No filaments | 99 |
| Filament Cross-section | Hollow, trilobal |

[(a)]Values in parentheses are for heat set yarn. Heat setting conditions: 126.6° C. (140° C. for polypropylene homopolymer), 6 bar, residence time 55 sec. (50 sec. for polypropylene homopolymer), 4.5 twists per inch of two ends of flat yarn.

Carpeting produced with compositions of the invention were tested for performance in a Hexapod Tumble Test typically used in the art to evaluate carpet performance. For comparison purposes test results are also reported for commercially produced carpet using nylon, 100% polypropylene homopolymer and polyester.

TABLE 1

Hexapod Carpet Test

PROCEDURE:

The test specimens were subjected to 8,000 or 16,000 cycles (as reported) of "Hexapod" tumbling, modified head, removing the specimen every 2,000 cycles for restoration by vacuuming. A Hoover upright vacuum cleaner (Model 1149) was used, making four (4) forward and backward passes along the length of the specimen.
The sample was assessed using the draft ISO conditions, daylight equivalent D65, vertical lighting giving 1500 lux at the carpet surface. Sample was viewed at an angle of 45 degrees from 1–1/2 meter distance, judging from all directions.
The sample was also measured for total thickness before and after testing to obtain a thickness retention value.

| RATING KEYS: OVERALL APPEARANCE | COLOR CHANGE |
|---|---|
| 5 = None or very slight change | 5 = Negligible or no change |
| 4 = Slight change | 4 = Slight change |
| 3 = Moderate change | 3 = Moderate change |
| 2 = Severe change | 2 = Considerable change |
| 1 = Very severe change | 1 = Severe change |
| Test Results: Overall Appearance | |
| Color Change | |
| Thickness Retained, % | |

Note: The recommended number of cycles for commercial carpet is 12,000 and for residential carpet 8,000.

TABLE 2

Hexapod Test Results

| Sample | No. Cycles | Overall Appearance | Color Change | Thickness Retained % |
|---|---|---|---|---|
| Comparative[(a)] | | | | |
| Nylon (Pet) | 8000 | 4 | 4 | 81.3 |
| | 16000 | 2–3 | 3 | 75.6 |
| Nylon (Rose) | 8000 | 4 | 4–5 | 82.6 |
| | 16000 | 2–3 | 3–4 | 81.9 |
| Polyester | 8000 | 3 | 3 | 86.0 |
| | 16000 | 2–3 | 3 | 71.1 |
| Polypropylene (Tan) | 8000 | 2 | 2–3 | 75.1 |
| PPM/HP[(b)] | | | | |
| 50/50 (Blue) | 8000 | 3 | 3–4 | 85.2 |
| | 16000 | 2–3 | 3 | 82.6 |
| 30/70 (Blue) | 8000 | 2–3 | 3 | 80.3 |
| | 16000 | 2 | 3 | 80.3 |
| 15/85 (Blue) | 8000 | 2–3 | 3 | 80.7 |
| | 16000 | 2 | 3 | 79.3 |
| 50/50 (Grey)[(c)] | 8000 | 3–4 | 3–4 | 83.7 |
| 15/85 (Grey)[(c)] | 8000 | 3 | 3–4 | 79.5 |
| 15/85 (Grey)[(d)] | 8000 | 2 | 3–4 | 78.5 |

[(a)]Polypropylene homopolymer, commercial grade; Nylon, Stainmaster brand; Pet. = commercial color "Petrified."
[(b)]PPM = Propylene polymer material (92.5% propylene, 2.5% ethylene, 5.0% butene-1); HP = crystalline polypropylene homopolymer.
[(c)]Preblended following polymer production to produce pellets of indicated composition.
[(d)]Color preblended into propylene polymer material (masterbatch).

The test results demonstrate significant improvement in resiliency as measured by thickness retained; additionally, overall appearance and color change is also improved compared to polypropylene homopolymer. It was observed that further improvement was required to increase resistance to streaking.

EXAMPLE 2

Carpet was also produced using 100% propylene polymer material of the same monomer composition as described in Example 1. Yarn was produced using a solid filament at a draw ratio of 3.9 at 120° C., a texturizing temperature of 110° C.; yarn shrinkage resulted in 7 twists per inch. Testing for resiliency in the hexapod test produced very good results although coverage was very poor for 40 ounce/sq. yard carpet equivalent to a standard polypropylene homopolymer product.

EXAMPLE 3

Yarn was prepared and carpet produced from the yarn was tested in the hexapod test based on the propylene polymer material of Example 1 blended with crystalline polypropylene homopolymer as in Example 1 at blend levels of 50% and 70% propylene polymer material. The spinning and drawing conditions used for these blends were the same as in Example 2 except that twist level and heat set conditions were modified to produce a yarn with 4.5 twists per inch; the yarns were then tufted and backed on industrial carpet lines. Although these compositions also showed streaking, their resiliency performance was significantly improved compared especially to the polypropylene control of Example 1 (Table 3).

TABLE 3

| Sample | No. Cycles | Overall Appearance | Color Change | Thickness Retained, % |
|---|---|---|---|---|
| PPM/HP | | | | |
| 50/50 (Rose) | 8000 | 4 | 4 | 87.3 |
| 70/30 (Tan) | 8000 | 4 | 4 | 88.6 |
| 50/50 (Tan) | 8000 | 3–4 | 3–4 | 81.7 |
| | 16000 | 2 | 3 | 79.1 |
| 70/30 (Rose) | 8000 | 3–4 | 4 | 82.9 |
| | 16000 | 2 | 3 | 77.5 |

EXAMPLE 4

Significant improvement in resistance to streaking was observed by improving yarn orientation during drawing. This was achieved at a draw ratio of 3.6 and texturizing temperature of 120° C. for blends containing 15, 30 and 50% propylene polymer material of Example 1 with polypropylene homopolymer. Additionally, the flat yarn had target properties of 60–70% elongation, shrinkage of 20%, 4.5 twists per inch, and was heat set at a temperature of 143° C. and a 50 sec. dwell time.

From the experience of the several carpet tests, it was concluded that overall improved carpet performance (including resilience, appearance and streaking) for a blend of 50% propylene polymer material of the type used in Example 1 with 50% polypropylene homopolymer can be expected using as extrusion conditions: 120° C. draw temperature and texturizing temperature, flat yarn denier of 1525±25 comprising 99 filaments and flat yarn elongation of 65%±10% (except 60% for hollow filament); twisting conditions: 4 turns per inch, 3200 denier, 85% max. elongation (except 80% max. for hollow filament); heat setting conditions to give 50% denier shrinkage (initially 260° F. (126.6° C.) heat set temperature at 54 sec. residence time).

EXAMPLE 5

Experiments were conducted utilizing yarn produced on commercial equipment as described in Example 1 hereinabove to further characterize the advantageous performance of the compositions disclosed and claimed. Yarn samples comprised spun and drawn filaments and corresponded to blend compositions of 50%PPM /50%HP and 15%PPM /85%HP, which were compared with 100% polypropylene homopolymer (HP) samples of various colors. The yarn samples were evaluated in laboratory designed tests to measure twist retention and shrinkage as a function of heat set temperature. Without intending to be bound by theory, it is proposed that improved resiliency is characterized by improved carpet appearance, tuft definition and twist retention.

Twist was introduced and retention and shrinkage measured in the laboratory as follows:

Thermal Shrinkage

Samples were treated using a "Thermal Shrinkage Tester" radiant heat oven manufactured by Testrite Ltd. A sample of yarn was clamped at one end and its other, free end, was draped over a drum which was free to rotate on a ball bearing; a pointer on the drum could be set to zero at the start of the test. To the free end of the sample a 9 g weight was attached corresponding to 0.005 g/denier for the 1800 denier yarn samples tested. The drum element, including the yarn, was placed in the oven at the desired temperature and shrinkage of the yarn was recorded based on the pointer movement which was observed at the oven temperature after 3 minutes elapsed time. % shrinkage=[(initial length-final length)/initial length]×100.

Twist Retention Test-Method A

Samples were tested using a "Twist Inserter," Model ITD-28, manufactured by Industrial Laboratory Equipment Co. A length of yarn was inserted into the Twist Inserter and 4.50 twists per inch imposed on the yarn by turning the crank of the tester. The ends of the yarn sample were tied-off and the twisted sample mounted on a "coupon" with the free ends fixed adjacent one another on the coupon. The twist was heat set at the indicated temperature for 10 minutes in a forced hot air oven after which the sample was removed and cooled at room temperature. One end of the sample was fixed and a 20 g weight was attached to the other end which was permitted to hang freely for approximately 18 hours. At the end of that time, the weight was removed and the sample allowed to recover at room temperature for one hour. The yarn was then re-installed in the Twist Inserter and the number of turns of the crank required to remove the residual twist (yarn filaments substantially parallel) was determined. % Twist Retention was calculated as=(Number of Twists Remaining/Initial Number of Twists)×100.

Figure 2:
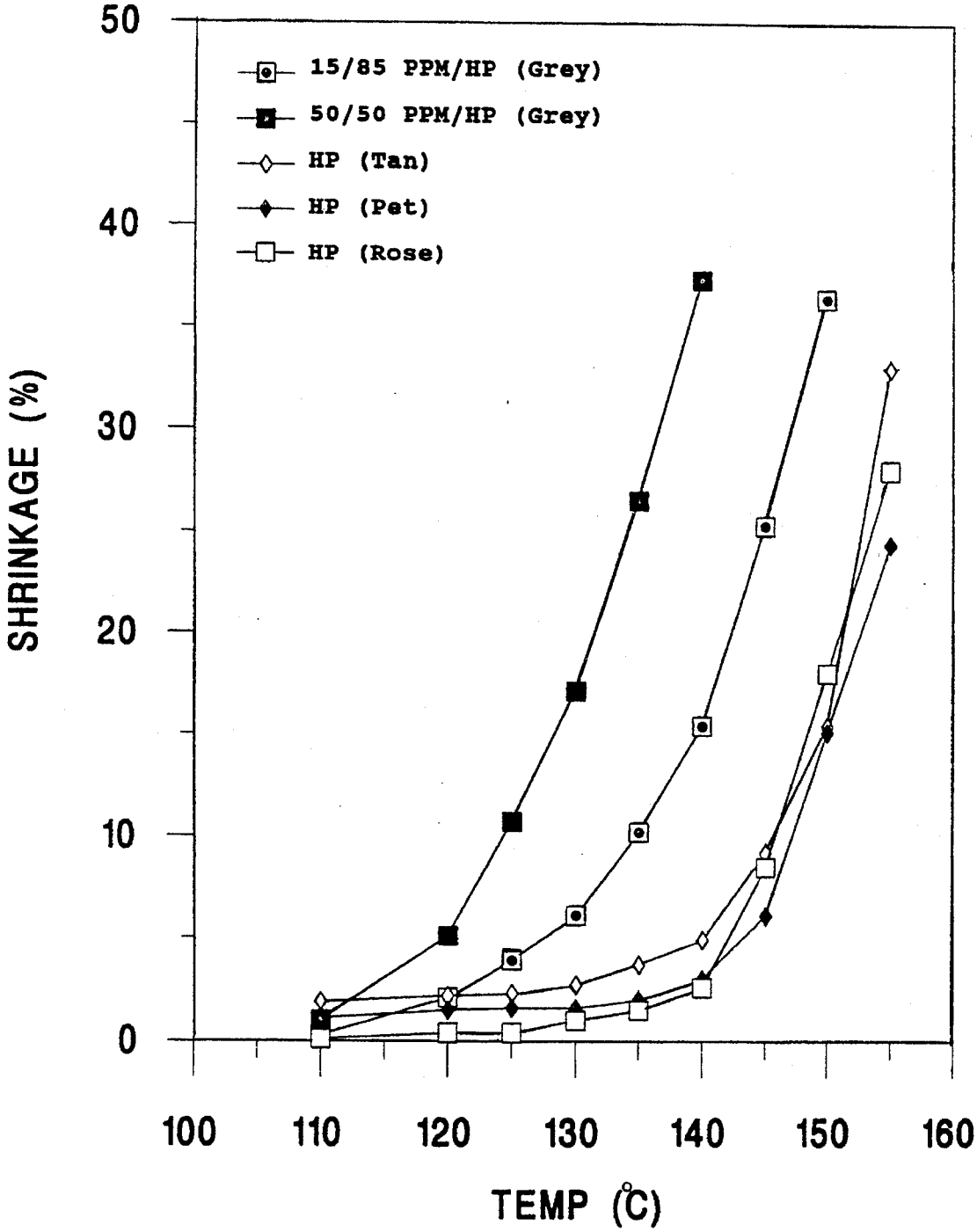
FIG. 2 is a graph showing the relationship between yarn shrinkage at various test temperatures for two blend composition embodiments of the invention and three control samples of pigmented polypropylene homopolymer.

As can be observed in FIG. 1, yarn based on compositions of the present invention, both the 50/50 and 85/15 blends, demonstrate superior twist retention at all heat set test temperatures compared to polypropylene homopolymer; twist retention for the 50/50 blend is exceptionally high at the high heat set temperatures. Referring to FIG. 2, it can be observed that the compositions of the present invention display greater shrinkage at elevated temperatures; the composition containing a higher concentration of the propylene polymer material shows a larger response.

EXAMPLE 6

Thermal analysis tests were conducted Using a differential scanning calorimeter (DSC). Initially, samples including homopolymer and blends, were pressed into film form and tested on an instrument manufactured by DuPont (Model 2100). In this test a small polymer sample (about 4 to 6 mg) is heated or cooled at a controlled rate (typically 20° C./min.) in a nitrogen atmosphere. The sample is heated or cooled under controlled conditions to measure melting, crystallization, glass transition temperatures, heat of fusion and crystallization, and to observe the breadth and shape of the melting or crystallization response. Tests were conducted on various samples representing 100% polypropylene homopolymer (HP, grade PD-382, manufactured by HIMONT U.S.A., Inc.; typical MFR=3) and blends of HP with propylene polymer material (PPM, target monomer levels same as the PPM of Example 1). Samples of 100%HP, 90%HP/10%PPM, 80%HP/20%PPM, 70%HP/30%PPM and 50%HP/50%PPM were heated from room temperature to about 230° C., cooled to about 40° C. and reheated. In addition, yarn samples corresponding to those of Example 5 were tested on an instrument manufactured by Perkin-Elmer (model DSC 7); the accuracy of this instrument also permits reporting of values for heat of fusion. The response curve for a sample can be affected by its heat history during preparation as well as being cycled through multiple heating and cooling cycles; e.g., thermal signatures due to crystalline structures can be enhanced and thermal transitions magnified. Other modifications can occur as a result of the presence of pigments since such additives can act as nucleators.

Results are reported in Table 4 for the initial heating cycle of each sample. It is observed that as the concentration of PPM in the blend increases, melting onset and peak temperature decreases. It is also observed that the process steps of fiber spinning and drawing which were used to produce a yarn material increased the melting temperature relative the blend samples. Furthermore, the values for heat of fusion of the yarn samples also decrease as the concentration of propylene polymer material increases. It is particularly noteworthy that in the polypropylene homopolymer yarn sample, the onset of melting in the initial heating cycle is very close to the melt temperature, $(T_m-T_{mo})=4°$ C., whereas the breadth of the melting transition observed with the yarn samples based on blends containing propylene polymer material is substantially greater, $(T_m-T_{mo})=10°$ C. Additionally, since propylene polymers are the dominant elements of all of the PPM compositions, the various components are compatible and the high strength of propylene based polymers is retained. Furthermore, yarn processing conditions can be maintained at levels consistent with technology for polypropylene homopolymer.

TABLE 4

| Differential Scanning Calorimetry (DSC)[a] | | | | |
|---|---|---|---|---|
| | | Initial Heating Cycle | | |
| Sample | Composition[b] | $T_{mo}$ | $T_m$ | $\Delta H_f$ |
| Blend | | | | |
| a | 100% HP | 148 | 162 | |
| b | 90 HP/10 PPM | 146 | 161 | |
| c | 80 HP/20 PPM | 146 | 160 | |
| d | 70 HP/30 PPM | 143 | 159 | |
| e | 50 HP/50 PPM | 144 | 158 | |
| Yarn | | | | |
| A | 100% HP | 161 | 165 | 91 |
| B | 85 HP/15 PPM | 154 | 163 | 78 |
| C | 50 HP/50 PPM | 150 | 160 | 71 |

[a]20° C./min., 50 cc/min $N_2$; All temperature values, °C.;
$T_{mo}$ = Melting onset; intersection of tangent at maximum slope of primary transition with baseline
$T_m$ = Peak melting temperature
$\Delta H_f$ = Heat of fusion, joules/g
[b]HP = polypropylene homopolymer (as described in text)
PPM = propylene polymer material (as described in text)

EXAMPLE 7

Using a slow Battaggion mixer one prepares 20 Kg of a polymer blend comprising 40% of (1) polypropylene homopolymer in the form of spherical particles having a diameter from 1 to 3 mm, and the following chemical-physical properties:

| | |
|---|---|
| insoluble in xylene at 25° C. | 4% by weight |
| number aver. molec. weight | 42,000 g/mole |
| weight aver. molec. weight | 270,000 g/mole |
| MFI | 11 g/10 min |
| ash at 800° C. | 100 ppm |

and 60% of (2) a heterophasic polyolefin composition comprising 40% by weight of polypropylene homopolymer and 60% by weight of an ethylene-propylene elastomeric copolymer (60% weight ethylene-40% weight propylene, 33% by weight insoluble in xylene at 25°). Such heterophasic composition has a MFI of 11 g/10min, and an flexural modulus of 400 MPa. The blend also includes the following additives and stabilizers: 0.05% by weight of Irganox 1010, 0.1% by weight of Irgafos 168, and 0.05% by weight of calcium stearate.

The mixture thus obtained is pelletized by extrusion at 220° C., and the pellets are spun in a system having the following main characteristics:

extruder with a 25 mm diameter screw, and a length/diameter ratio of 25, with capacity from 1.0 to 3.0 Kg/h;

10-hole die with hole diameter of 1.0 mm and L/D ratio=5;

metering pump;

air quenching system with temperatures from 18° to 20° C.;

Draw mechanism with a rate ranging from 250 to 1500 m/min;

stretch mechanism for the fibers, equipped with rollers having a variable velocity ranging from 30 to 300 m/min., and a steam operated stretch oven.

The spinning and stretching conditions used are:

a) die temperature: 260° C.

b) hole flow rate: 2.84 g/min.

c) draw rate: 650 m/min.

d) stretch ratio 1/3.35.

The main mechanical characteristics of the fibers thus obtained are comprised within the following ranges:

content (ASTM D1577–79): 15–19 dtex;

tenacity (ASTM D2101–82): 18–22 cN/tex elongation at break (ASTM D2101–82); 100–200%.

The shrink values are determined by measuring the length of the samples of fibers before and after exposure to heat treatment for 20 min. in an oven with the thermostat set at 110° C., 130° C., or 140° C.; measured values are shown in Table 5.

EXAMPLE 8

By using a slow Battaggion mixer one prepares 20 Kg of a polymer blend comprising 24% of (1) polypropylene homopolymer in the form of spherical particles having a diameter from 1 to 3 mm, and the following chemical-physical properties:

| | |
|---|---|
| insoluble in xylene at 25° C. | 4% by weight |
| number aver. molec. weight | 42,000 g/mole |
| weight aver. molec. weight | 270,000 g/mole |
| MFI | 11 g/10 min |
| ash at 800° C. | 100 ppm |

and 76% of (2) a heterophasic polyolefin composition comprising 50% by weight of a crystalline random copolymer of propylene with ethylene (containing 2.5% by weight of ethylene), and 50% by weight of an ethylene-propylene elastomeric copolymer (60% weight ethylene-40% weight propylene, 33% by weight insoluble in xylene at 25° C.). Such heterophasic composition has a MFI of 5 g/10 min, and an flexural modulus of 400 Mpa.

The blend also includes the following additives and stabilizers: 0.05% by weight of Irganox 1010, 0.1% by weight of Irgafos 168, and 0.05% by weight of calcium stearate.

The mixture thus obtained is pelletized by extrusion at 220° C., and the pellets are spun in a system having the same characteristics as in Example 7.

The main mechanical characteristics of the fibers thus obtained are comprised within the same ranges as in Example 7. The shrink values are determined in Example 7. The fibers thus obtained are also subjected to an accelerated life test ("Tetrapod") after which they are examined under an electron microscope in order to determine the presence or absence of fibrillation. The results of said test are also shown in Table 5. By way of comparison, the first three entries in Table 5 shows the shrink and life test results obtained on other fiber samples (PP=polypropylene homopolymer, P=propylene, E=ethylene, LDPE=low density polyethylene). Fiber based on crystalline, random copolymer has some of the desirable features, but its shrinkage response at the lowest temperature is more limited, resulting in a stronger temperature sensitivity than the fibers of Examples 7, 8 and 9.

EXAMPLE 9

Some thermoshrinkable fibers are obtained by operating as in Example 7, the only difference being that the components of mixture (1) and (2) are blended in quantities of 50% by weight. The shrink value of the fibers thus obtained are shown in Table 5.

The fibers thus obtained are also subjected to the accelerated life test ("Tetrapod") after which they are examined under an electron microscope in order to determine the presence or absence. of fibrillation; test results are also shown in Table 5.

TABLE 5

| Polymer Composition | Shrinkage (%) @ 110° C. | 130° C. | 140° C. | Fibrillation |
|---|---|---|---|---|
| PP homopolymer | 4.0 | 7.0 | 8.0 | Absent |
| Crystalline Random P/E copolymer (E = 4% by wt.) | 5.0 | 27.0 | 50.0 | Absent |
| PP/LDPE mechanical blend (75/25 by wt.) | 17.0 | 23.0 | 26.0 | Present |
| EXAMPLE 7 | 17.0 | 22.0 | 23.0 | Absent |
| EXAMPLE 8 | 22.0 | 27.0 | 29.0 | Absent |
| EXAMPLE 9 | 11.0 | 15.0 | 17.0 | Absent |

EXAMPLE 10

Samples of yarn were prepared for use in tufting operations using polypropylene homopolymer (HP) as a reference and compositions of a 50/50 blend of polypropylene homopolymer and propylene polymer material (PPM) as described in Example 1 (propylene-ethylene-butene-1 terpolymer). Conditions of yarn preparation for the latter samples were modified in order to obtain different levels of shrinkage and associated differences in denier and TPI (the values in the following table referring to in/out correspond to before/after shrinkage).

| Sample | Shrinkage | Denier IN | Denier OUT | TPI IN | TPI OUT |
|---|---|---|---|---|---|
| HP | 9 | 3456 | 3780 | 3.4 | 4.3 |
| HP/PPM (50/50) | 11 | 3510 | 3960 | 2.9 | 3.3 |
| HP/PPM (50/50) | 46 | 3330 | 4860 | 2.9 | 4.5 |
| HP/PPM (50/50)[a] | 59 | 3330 | 5310 | 3.0 | 4.8 |

[a]Alternate processing conditions

These results demonstrate that yarn processing conditions can affect resulting shrinkage and other properties, but that the compositions of the present invention are capable of significantly higher valves than prior art materials.

EXAMPLE 11

Samples of the compositions of Example 10 were made into saxony-type test carpets and performance was evaluated in the Hexapod test and in walk-out tests. Carpet samples differing in face weight (30 ounce and 40 ounce) were also compared. Little difference in performance is observed in level loop construction carpeting produced from non heat-set yarn. Results are summarized below.

| Composition (HP/PPM)[a] | Shrink (%) | Face Wt. (oz.) | FHA Density[b] | Hexapod[c] Rank | Color | Texture | Thk. |
|---|---|---|---|---|---|---|---|
| 100/– | 15 | 30 | 2160 | 4 | 1.8 | 1.7 | 63 |
| 100/– | 15 | 40 | 2880 | 3 | 2.5 | 2.7 | 73 |
| 50/50 | 60 | 30 | 2160 | 2 | 2.3 | 3.0 | 75 |
| 50/50 | 60 | 40 | 2880 | 1 | 3.3 | 3.2 | 81 |
| 100/– | 9 | 40 | 2880 | 3 | 2.5 | 2.7 | 60 |
| 50/50 | 11 | 40 | 2880 | 2 | 2.5 | 2.3 | 66 |
| 50/50 | 50 | 40 | 2880 | 1 | 3.3 | 3.5 | 76 |

[a]First four samples prepared at one facility; last three at another.
[b]FHA density = 36 × face weight ÷ pile height.
[c]Data at 12,000 cycles; Rank: 1 = best; Thk. = thickness, % retained.

The carpet samples described above were tested in a "walk-out" test by placing the samples in an area frequented by regular foot traffic (e.g., library or office entrance). Following the estimated number of treads, samples were evaluated for appearance retention relating to resiliency, tuft tip retention and soiling; rating scale is 1 to 5 where 5 is best. Compositions of the present invention were superior.

| Composition (HP/PPM) | Weight (oz.) | Treads ($\times 10^{-3}$) | Rating |
|---|---|---|---|
| 100/– | 30/40 | 10 | 2.5/3.0 |
| 100/– | 30/40 | 25 | 1.0/2.0 |
| 50/50 | 30/40 | 10 | 3.5/4.0 |
| 50/50 | 30/40 | 25 | 3.0/3.5 |

EXAMPLE 12

Samples of polypropylene homopolymer yarn were evaluated for shrinkage response. Flat yarn (i.e., not textured) was prepared at various draw ratios. It was observed that undrawn yarn had a shrinkage of 1% at 120° C. and 135° C. Flat yarn drawn at increasing draw ratios showed a shrinkage response at (120° C. –135° C.) that started at about 10% and decreased to about 4% at the maximum draw ratio. Yarn that was drawn and textured, the latter at 140° C., showed no shrinkage at temperatures of 140° C. or less and 4% at 145° C. This illustrates the effect of processing variations on shrinkage response as well as the limited shrinkage "reservoir" of polypropylene homopolymer.

EXAMPLE 13

Compositions described in Example 11 above were made into yarn and carpet for evaluation as follows:

| Yarn Properties[a] | HP-100 | | HP-50/PPM-50 | |
|---|---|---|---|---|
| Denier, twisted/heat-wet | 3420/3780 | | 3510/5670 | |
| Tenacity, g/d | 2.2 | | 1.2 | |
| Elongation, % | 44.8 | | 124.1 | |
| Initial Modulus, g/d | 7.5 | | 2.0 | |
| Crimp level per inch | 14.8 | | 32.0 | |
| Carpet Properties[b] | | | | |
| % Recovery (4 psi load) | | | | |
| Control | 95.3/94.3 | | 92.5/92.5 | |
| Low Traffic | 92.7/91.6 | | 92.4/91.1 | |
| High Traffic | 91.7/92.7 | | 93.9/92.1 | |
| Thermal Shrinkage[c] | °C. | % | °C. | % |
| | 145 | 2.2 | 120 | 1.9 |
| | 150 | 5.7 | 125 | 4.9 |
| | 155 | 11.0 | 130 | 10.6 |
| | 160 | 19.6 | 140 | 17.2 |

[a]Properties for twisted/heat-set yarn except for initial denier.
[b]Values for 40 oz/30 oz face wt. carpets; Low traffic = 10K steps, High = 25K steps.
[c]Extrapolated to zero tension at temperature indicated.

Visual evaluation of carpet samples after walk-out testing ranked the 50/50 blend composition better than the 100% homopolymer in either 30 oz. or 40 oz. face weight and at low and high traffic levels; also, pile height retention was improved. The capacity for thermal shrinkage is shown to be significantly greater in the compositions of the present invention. It can be noted that in commercial saxony carpet operations shrinkage typically occurs under conditions of substantially zero tension.

EXAMPLE 14

Carpet samples were prepared on commercial equipment including a control of 100% polypropylene homopolymer, a propylene polymer material of the invention comprising a crystalline propylene-ethylene random copolymer (3 wt. % ethylene, $C_2$) and a 50/50 blend of polypropylene homopolymer/propylene polymer material as described in Example 10. The latter two compositions were made into carpets at various conditions so as to obtain different shrinkage levels. Additionally, commercial carpet samples were included in the tests for comparison. Appearance ratings were obtained from Hexapod testing.

| Carpet[a] | Shrinkage (%) | TPI[c] | Face Wt. (oz.) | Hexapod Texture[d] |
|---|---|---|---|---|
| HP-100 | 4 | 3.1 | 40 | 2.0 |
| 3% $C_2$ | 40 | 4.2 | 40 | 3.7 |
| 3% $C_2$ | 10 | 3.3 | 40 | 2.7 |
| HP-50/PPM-50 | 50 | 4.5 | 40 | 3.7 |
| HP-50/PPM-50 | 60 | 4.8 | 40 | 4.2 |
| HP-50/PPM-50 | 28 | e | e | 2.7 |
| HP-50/PPM-50 | 38 | f | f | 3.0 |
| Nylon | — | 3.5 | 38 | 3.7 |
| PP | — | 4.5 | 38 | 3.0 |

[a]Nylon = commercial sample (STAINMASTER brand, DuPont) PP = commercial polypropylene carpet (AMOCO)
[b]shrinkage during heat setting; values for commercial samples are unknown.
[c]TPI, twists per inch, in heat-set yarn
[d]based on 12,000 cycles
[e]Initial yarn denier = 1100; final = 3418
[f]Initial yarn denier = 1500; final = 4323

Texture ratings are improved (higher) at higher levels of shrinkage in the polyolefin compositions and the values for these compositions equal or exceed those of the commercial samples.

EXAMPLE 15

Carpet yarn based on blends of 50% homopolymer polypropylene and 50% propylene polymer material as described in Example 10 were textured at various temperatures and heat-set at 132° C. and 143° C.; shrinkage is with reference to the heat-set temperature.

| Texturing Temperature | Shrinkage, % | |
|---|---|---|
| (°C.) | 132° C. | 143° C. |
| 110 | 18 | 43 |
| 115 | 14 | 36 |
| 120 | 11 | 31 |
| 130 | 7 | 26 |
| 140 | 5 | 18 |

It is observed that, as texturing temperature is increased, the high level of shrinkage originally available in the heat-set yarn decreases; the "reservoir" of available shrinkage is depleted. Additionally, shrinkage increases as the heat-set temperature increases. However, if the heat-set temperature is excessive, overall melting of the yarn can occur with loss of utility.

EXAMPLE 16

Various polymers and compositions were prepared in order to further define the invention by evaluating their ability to be spun into fibers, their capability for shrinkage and whether they resulted in improved carpeting relative to polypropylene homopolymer. Carpet performance was measured in the Hexapod test at 12,000 cycles using the appearance rating criteria; a control carpet of polypropylene homopolymer prepared under similar conditions results in an appearance rating of 2.0 in this test. The materials and results were as follows:

(a) Linear low density polyethylene (LLDPE): a commercial copolymer containing 8% butene-1 (Exxon Chemical Co.) was evaluated in blends with polypropylene homopolymer. A 50/50 blend was not spinnable into textured yarn and was not further evaluated (The addition of ethylene-propylene copolymer rubber did not improve performance). A blend containing 7% LLDPE resulted in fibers which showed a shrinkage response, but the Hexapod appearance rating was only 1.0.

(b) Polybutylene (PB): a commercial homopolymer (PB0400, manufactured by Shell Chemical Co.) was evaluated in blends with polypropylene homopolymer at levels of 25, 35 and 50% PB. In each instance shrinkable yarn could be produced, but the resulting carpet had poor initial appearance; the sample containing 25% PB had a Hexapod appearance rating of 1.7.

(c) Substantially noncrystalline ethylene-propylene copolymer (EPC): a blend of 50% polypropylene homopolymer with 50% of a commercial, as- polymerized, composition of 37% polypropylene homopolymer with 63% EPC containing 29% ethylene and 71% propylene and substantially noncrystalline (HIMONT U.S.A., Inc., grade KS080) resulted in yarn slightly more shrinkable than polypropylene homopolymer during heat setting. Carpet evaluated in the Hexapod appearance test gave a rating of 1.5.

(d) Ethylene random copolymer: a crystalline random copolymer containing 3.1% ethylene (HIMONT U.S.A., Inc., grade SA849S) was evaluated in a 50/50 blend with polypropylene homopolymer, thus providing a low level of copolymer in the final composition. The Hexapod test result was equivalent to polypropylene homopolymer. A copolymer containing 5.9% ethylene evaluated in a 50/50 blend with polypropylene homopolymer produced a carpet that gave a rating of 2.3.

(e) Propylene random copolymers and terpolymers: a butene-1 ($C_4$)/propylene ($C_3$) polymer and an ethylene ($C_2$)/$C_3$/$C_4$ polymer were each evaluated as a 30/70 blend with polypropylene homopolymer and resulted in slightly improved performance relative to polypropylene homopolymer in the Hexapod appearance rating test as follow:

| | Comonomer Content, Wt. % | | | |
|---|---|---|---|---|
| Sample | $C_2$ | $C_4$ | $C_3$ | Rating[a] |
| 1 | — | 16.5 | 83.5 | 2.5 |
| 2 | 4 | 5 | 91 | 2.8 |

[a]The rating for a polypropylene homopolymer control in this test was 2.2

Other features, advantages and embodiments of the invention disclosed herein will be readily apparent to those exercising ordinary skill after reading the foregoing disclosures. In this regard, while specific embodiments of the invention have been described in considerable detail, variations and modifications of these embodiments can be effected without departing from the spirit and scope of the invention as described and claimed.

What is claimed is:

1. A saxony carpet containing a primary backing and twisted, evenly sheared, heat-set pile yarn, said yarn being in the form of individual lengths of plied yarn or tufts, each of which is attached to and projects upwardly from said backing and terminates as a cut end, said pile yarn comprising propylene polymer yarn of increased resiliency and shrinkage compared to crystalline propylene homopolymer yarn, having a continuous strand of multiple monofilament fibers, said fibers consisting essentially of a member selected from the group consisting of, by weight, I. a blend of crystalline propylene homopolymer at a concentration of about 10–70% of the blend, and (a) a random crystalline terpolymer consisting essentially of about 96.0–85.0% of propylene, about 1.5–15.0% of ethylene, and about 2.5–10% of a $C_4$–$C_8$ alpha-olefin or (b) a random, crystalline, propylene polymer consisting essentially of propylene and about 1.5–20.0% of an olefin selected from the group consisting of ethylene and C4–C8 aplha-olefins; and II. a proplylene polymer material, optionally in a blend with crystalline, propylene homopolymer, said homopolymer being at a concentration up to about 70% of the blend, said propylene polymer material being selected from the group consisting of:

(a) a composition of random, crystalline, propylene polymers consisting essentially of:

(1) about 30–65% of a copolymer of about 80–90% propylene, and a $C_4$–$C_8$ alpha-olefin, and (2) about 35–70% of a copolymer of propylene and ethylene and optionally about 2–10% of a $C_4$–$C_8$ alpha-olefin, said copolymer containing about 2–10% ethylene when said $C_4$–$C_8$ alpha-olefin is not present, and about 0.5–5% ethylene when said $C_4$–$C_8$ alpha-olefin is present;

(b) a composition of random, crystalline, propylene polymers and a predominantly ethylene copolymer, which composition consists essentially of:

(1) about 15–35% of a terpolymer of about 90–93% propylene, about 2–3.5% ethylene, and about 5–6% $C_{4-C8}$ alpha-olefin, (2) about 30–75% of a copolymer of about 80–90% propylene, and a $C_4$–$C_8$ alpha-olefin, and (3) about 20–60% of a copolymer of about 91–95% ethylene, and a $C_4$–$C_8$ alpha-olefin;

(c) a heterophasic, polyolefin composition consisting essentially of:

(1) 90–55% of polymeric material selected from the group consisting of a propylene homopolymer having an isotactic index greater than 90, and a crystalline copolymer of propylene and an alpha-olefin of the formula $CH_2{=}CHR$, where R is H or $C_2$–$C_6$ alkyl said olefinic material being less than 10% of the copolymer, and (2) 10–45% of an elastomeric polymer and propylene and olefinic material selected from the group consisting of alpha-olefins of the formula $CH_2{=}CHR$, where R is H or $C_{2-6}$ alkyl, said olefinic material being 50–70% of said elastomeric copolymer, and 10–40% of said elastomeric copolymer being insoluble in xylene at ambient temperature.

2. The carpet of claim 1 the yarn is comprised of bulk continuous fibers or staple fibers.

* * * * *

UNITED STATES PATENT AND TRADEMARK OFFICE
CERTIFICATE OF CORRECTION

PATENT NO. : *5,622,765*

DATED : *April 22, 1997*

INVENTOR(S) : *Luciano Clementini et al*

It is certified that error appears in the above-identified patent and that said Letters Patent is hereby corrected as shown below:

*At col. 4, line 53, change "6.0" to --16.0--.*

*At col. 5, line 19, change "05" to --0.5--.*

*At col. 7, line 22, change "0°C." to --20°C.--.*

*At col. 8, lines 66 & 67, change "$2x10^{-}{}_{13}$%" to --$2x10^{-13}$%--.*

*At col. 12, line 65, insert --%-- after "wt."*

*At col. 24, line 29, change "80-90%" to --80-98%--.*

*At col. 24, line 56, change "and" to --of--.*

Signed and Sealed this

Fourteenth Day of July, 1998

Bruce Lehman

*Attest:*

BRUCE LEHMAN

*Attesting Officer*

*Commissioner of Patents and Trademarks*